US008136507B2

(12) United States Patent
Nagai

(10) Patent No.: US 8,136,507 B2
(45) Date of Patent: Mar. 20, 2012

(54) FUEL SUPPLY SYSTEM

(75) Inventor: Mitsuru Nagai, Okazaki (JP)

(73) Assignee: Denso Corporation, Kariya (JP)

( * ) Notice: Subject to any disclaimer, the term of this patent is extended or adjusted under 35 U.S.C. 154(b) by 302 days.

(21) Appl. No.: 12/683,567

(22) Filed: Jan. 7, 2010

(65) Prior Publication Data

US 2010/0196172 A1 Aug. 5, 2010

(30) Foreign Application Priority Data

Feb. 2, 2009 (JP) ..... 2009-21875

(51) Int. Cl.
*F02M 37/04* (2006.01)
*F02M 55/02* (2006.01)

(52) U.S. Cl. ..... 123/468; 123/510

(58) Field of Classification Search ..... 123/445, 123/468, 510, 495
See application file for complete search history.

(56) References Cited

U.S. PATENT DOCUMENTS

| | | | | |
|---|---|---|---|---|
| 6,021,761 | A * | 2/2000 | Kellner et al. | 123/495 |
| 7,077,107 | B2 * | 7/2006 | Boos et al. | 123/446 |
| 7,128,054 | B2 | 10/2006 | Koehler et al. | |
| 7,314,351 | B2 * | 1/2008 | Kuroda | 417/251 |
| 7,343,901 | B2 * | 3/2008 | Mori et al. | 123/446 |
| 7,377,753 | B2 * | 5/2008 | Kuroda | 417/251 |
| 7,527,035 | B2 * | 5/2009 | Schroeder | 123/446 |
| 7,594,499 | B2 | 9/2009 | Suzuki et al. | |
| 7,743,751 | B2 * | 6/2010 | Yonemoto | 123/514 |
| 7,793,642 | B2 * | 9/2010 | Yonemoto et al. | 123/514 |
| 7,874,284 | B2 * | 1/2011 | Sano | 123/511 |
| 2004/0208753 | A1 * | 10/2004 | Mori | 417/244 |
| 2008/0178845 | A1 * | 7/2008 | Shimai | 123/446 |

FOREIGN PATENT DOCUMENTS

| | | |
|---|---|---|
| JP | 08-014131 | 1/1996 |
| JP | 2007-85332 | 4/2007 |

OTHER PUBLICATIONS

Japanese Office Action dated Mar. 8, 2011, issued in corresponding Japanese Application No. 2009-021875 with English Translation.

* cited by examiner

*Primary Examiner* — Thomas Moulis
(74) *Attorney, Agent, or Firm* — Nixon & Vanderhye PC

(57) ABSTRACT

A fuel supply system includes a feed pump pumping up fuel in a fuel tank, a filter removing a foreign matter contained in the fuel discharged from the feed pump, and a high-pressure pump pressuring and discharging the fuel toward an internal combustion engine. A fuel pipe introducing the fuel from the filter to the high-pressure pump and a fuel pipe introducing the fuel from the filter to a housing of the high-pressure pump are formed independently of each other.

13 Claims, 1 Drawing Sheet

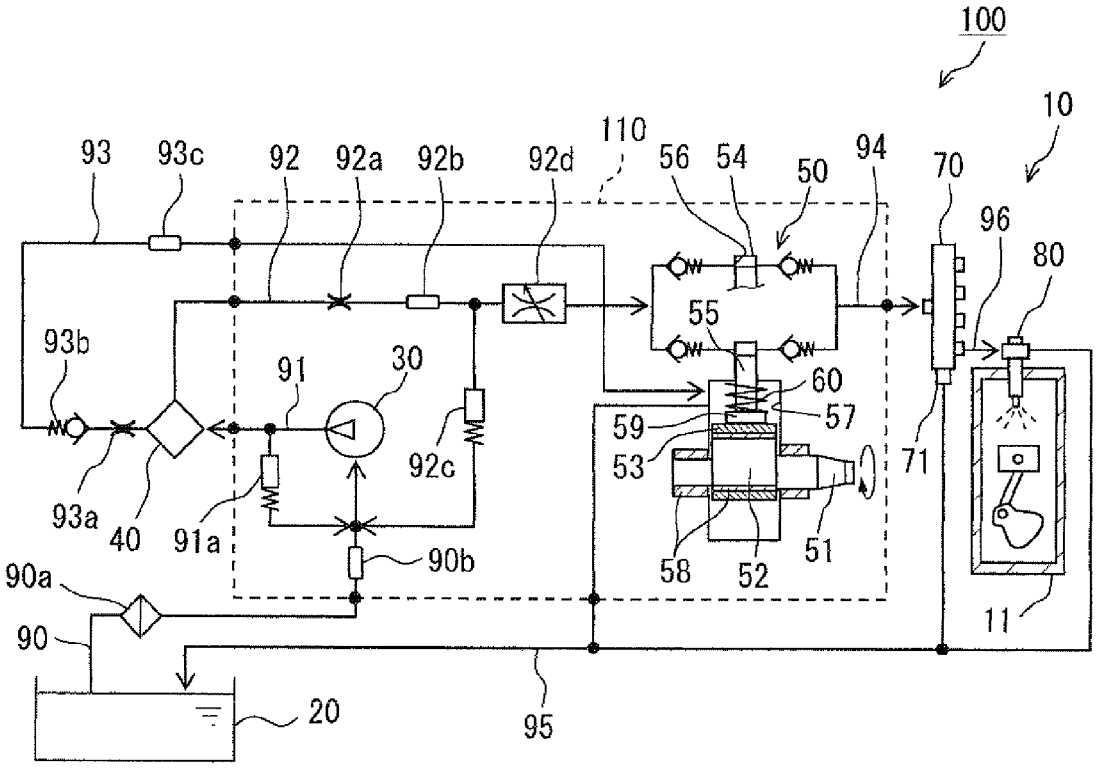
100
10
110
93
93c
92
92a
92b
92d
56
54
50
94
70
96
80
55
93b
91
30
60
57
59
53
92c
71
93a
40
91a
90b
58
52
51
90a
11
90
20
95

FUEL SUPPLY SYSTEM

CROSS-REFERENCE TO RELATED APPLICATION

This application is based on Japanese Patent Application No. 2009-21875 filed on Feb. 2, 2009, the disclosure of which is incorporated herein by reference.

FIELD OF THE INVENTION

The present invention relates to a fuel supply system which supplies fuel in a fuel tank to an internal combustion engine.

BACKGROUND OF THE INVENTION

JP-2007-85332A shows a fuel supply system which is provided with a feed pump and a high-pressure pump. The feed pump pumps up fuel in a fuel tank and supplies the fuel to the high-pressure pump. The high-pressure pump pressurizes the fuel and supplies the pressurized fuel to an internal combustion engine. The high-pressure pump is comprised of a cam driven by a camshaft, a plunger reciprocated by the cam, a fuel pressurizing chamber of which inner pressure is varied by the plunger, and a cam chamber accommodating the cam shaft and the cam. The fuel discharged from the feed pump is introduced to the fuel pressurizing chamber through a first pipe. A second pipe is branched from the first pipe to introduce the fuel to the cam chamber. A part of the fuel discharged from the feed pump flows into the second pipe through the first pipe. The fuel supplied from the feed pump to a housing through the second pipe functions as lubricant lubricating sliding portions of the high-pressure pump.

As described above, the second pipe is branched from the first pipe. Since these pipes are made by aluminum die-casting, it is likely that a metallic burr is produced at a portion where the second pipe is branched. The burr may fall off inside of the pipes due to fuel flowing pressure and may mix in the fuel flowing through the pipes. A cleanliness of the fuel which is to be supplied to the cam chamber may be deteriorated.

Besides, since the first pipe introduces the fuel into the fuel pressurizing chamber of the engine, it is necessary to provide an orifice in the second pipe in order to ensure fuel quantity supplied to the engine through the first pipe and to restrict an excessive fuel supply to the cam chamber. Foreign matters contained in the fuel easily adhere on the orifice. The foreign matters may fall off inside of the second pipe and may mix in the fuel flowing through the second pipe. The cleanliness of the fuel which is to be supplied to the cam chamber may be deteriorated.

Furthermore, the foreign matters may adhere on a fuel quantity regulation valve provided in the first pipe. The foreign matters may fall off inside of the first pipe and may mix in the fuel flowing through the first pipe. Then, the foreign matters flow from the first pipe to the second pipe by pulsation of the feed pump, whereby the cleanliness of the fuel which is to be supplied to the cam chamber may be deteriorated.

As described above, in the system having the second pipe branched from the first pipe, the burr of the pipes and foreign matters adhering on the orifice and the fuel quantity regulation valve may deteriorate the cleanliness of the fuel which is to be supplied to the cam chamber, so that the lubricating ability of the fuel may be deteriorated. An anti-seizure of the sliding portion of the high-pressure pump may be deteriorated.

SUMMARY OF THE INVENTION

The present invention is made in view of the above matters, and it is an object of the present invention to provide a fuel supply system which enables to restrict a deterioration of an anti-seizure of a sliding portion of a high-pressure pump by restricting a deterioration of cleanliness of fuel which functions as lubricant.

According to the present invention, a fuel supply system includes a feed pump pumping up the fuel in the fuel tank, a filter removing a foreign matter contained in the fuel discharged from the feed pump, and a high-pressure pump suctioning and pressurizing the fuel filtrated by the filter. The high-pressure pump discharges the pressurized fuel toward the internal combustion engine. The high-pressure pump includes a camshaft driven by the internal combustion engine, a cam rotated along with the camshaft, a plunger reciprocated by the cam, a fuel pressurizing chamber in which the fuel is suctioned and pressurized by a reciprocation of the plunger, and a housing accommodating a part of the plunger, the cam, and the camshaft. The fuel is supplied from the fuel tank to the feed pump through a first fuel pipe. The fuel is supplied from the feed pump to the filter through a second fuel pipe. The fuel is supplied from the filter to the fuel pressurizing chamber through a third fuel pipe. The fuel is supplied from the filter to the housing through the fourth fuel pipe. The third fuel pipe and the fourth fuel pipe are formed independently of each other.

That is, the fourth fuel pipe is a dedicated fuel pipe for introducing the fuel from the filter to the housing. A deterioration of lubricating ability of the fuel is restricted, and a deterioration of an anti-seizure of a sliding portion of a high-pressure pump is restricted. Thereby, unlike the structure in which the fourth fuel pipe is branched from the third fuel pipe, it is restricted that the burr of the pipes, the foreign matters adhering on the orifices, and the foreign matters adhering on the fuel quantity regulation valve deteriorate the cleanliness of fuel supplied to the housing as lubricant. A deterioration of lubricating ability of the fuel is restricted, and a deterioration of an anti-seizure of a sliding portion of a high-pressure pump is restricted.

BRIEF DESCRIPTION OF THE DRAWING

Other objects, features and advantages of the present invention will become more apparent from the following description made with reference to the accompanying drawing, in which like parts are designated by like reference numbers and in which:

Figure is a schematic view of a fuel supply system according to an embodiment of the present invention.

DETAILED DESCRIPTION OF EMBODIMENTS

Hereafter, an embodiment of the present invention is described.

Figure is a schematic view of a fuel supply system. A casing 110 indicated by a dashed line accommodates a feed pump 30 and a high-pressure pump 50.

A fuel supply system 100 is applied to an internal combustion engine 10 and controlled by an electric control unit (ECU: not shown). The fuel supply system 100 includes the feed pump 30 pumping up fuel in a fuel tank 20, a filter 40 removing foreign matters contained in the fuel discharged from the feed pump 30, and a high-pressure pump 50 suctioning and pressurizing the filtrated fuel. The high-pressure pump 50 discharges the pressurized fuel to the internal combustion engine 10. The internal combustion engine 10 includes four-cylinder engine body 11, a common rail 70 accumulating high-pressure fuel supplied from the high-pressure pump 50, and injectors 80 injecting the fuel supplied from the common rail 70 toward a combustion chamber of the engine body 11.

The feed pump 30 pumps up the fuel in the fuel tank 20 through a first fuel pipe 90 and discharges the fuel to the filter 40 through a second fuel pipe 91.

The feed pump 30 is a trochoid pump driven by a cam shaft 51 of the high-pressure pump 50.

The filter 40 removes foreign matters and gas contained in the fuel discharged from the feed pump 30. The filter 40 includes a filter element made of nonwoven fabric and a storage portion storing the fuel therein. The filter element of the filter 40 has higher performance for removing foreign matters than a first gauze filter 90*b* disposed in the first fuel pipe 90. The filter element removes fine foreign matters which the first gauze filter 90*b* can not remove. The storage portion stores the fuel to remove gas contained in the stored fuel. An inlet port of the third fuel pipe 92 is provided at a lower portion of the storage portion, and an inlet port of the fourth fuel pipe 93 is provided at an upper portion of the storage portion. The amount of gas contained in the stored fuel is gradually decreased from an upper portion to a lower portion. The fuel containing small amount of gas is supplied to the high-pressure pump 50 through the third fuel pipe 92. The fuel containing large amount of gas is supplied to a housing 57 through the fourth fuel pipe 93.

The high-pressure pump 50 supplies the pressurized fuel to the engine body 11. The high-pressure pump 50 is comprised of the cam shaft 51 driven by the engine 11, a cam 52 driven by the cam shaft 51, a cam ring 53 reciprocated by the cam 52, a plunger 55 reciprocated in a cylinder 54 by the cam ring 53, a fuel pressurizing chamber 56 of which inner pressure is varied by the plunger 55, and a housing 57 accommodating a part of plunger 55, the cam ring 53, the cam 52, and the cam shaft 51. The fuel is suctioned to the fuel pressurizing chamber 56 from the filter 40 by the pressure variation in the fuel pressurizing chamber 56. The pressurized fuel in the fuel pressurizing chamber 56 is supplied to the common rail through a discharge pipe 94.

The cam shaft 51 is slidably supported by the housing 57 through a metal bush 58, and the cam ring 53 is slidably supported by the cam 52 through the metal bush 58. Thereby, the cam shaft 51 is rotatable relative to the housing 57, and the cam ring 53 goes up and down relative to the cam 52.

A tappet 59 is integrally provided at an end of the plunger 55 in such a manner as to confront the cam ring 53. A spring 60 is disposed between the tappet 59 and an inner surface of the housing 57. The plunger 55 is biased toward an outer surface of the cam ring 53 by the spring 60, so that the plunger 55 is fixed on the outer surface of the cam ring 53 and is reciprocated by the cam ring 53.

The housing 57 is connected to the fuel tank 20 through the fifth fuel pipe 95. Thus, a part of fuel stored in the housing 57 is returned to the fuel tank 20 through the fifth fuel pipe 95. Besides, an inlet port of the fifth fuel pipe 95 provided to the housing 57 is positioned above a sliding portion between the plunger 55 (tappet 59) and the cam ring 53, a sliding portion between the cam ring 53 and the metal bush 58, a sliding portion between the metal bush 58 and cam 52, a sliding portion between the cam shaft 51 and the metal bush 58, and a sliding portion between the metal bush 58 and the housing 57.

Besides, an outlet port of the fourth pipe 93 provided to the housing 57 is also positioned above the sliding portions. Thereby, regardless of a level of the fuel stored in the housing 57, the fuel discharged from the outlet port of the fourth pipe 93 can flow into the sliding portions through the plunger 55, the tappet 59, the cam ring 53, the metal bush 58, the cam 52, and the camshaft 51.

The common rail 70 accumulates the high-pressure fuel supplied from the high-pressure pump 50 at a specified rail pressure. The accumulated fuel in the common rail 70 is supplied to the injectors 80 through a high-pressure pipe 96. The specified rail pressure is set by the ECU based on the accelerator position, the engine speed and the like. The common rail 70 is provided with a pressure limiter 71 which opens when the accumulated pressure in the common rail 70 exceeds a specified upper limit. The pressure limiter 71 is connected to the fuel tank through the fifth fuel pipe 95. Thereby, the excess fuel discharged from the pressure limiter 71 is returned to the fuel tank 20 through the fifth fuel pipe 95. Besides, the specified upper limit is previously determined.

The injector 80 is mounted in each of the respective cylinders, and injects the high-pressure fuel supplied from the common rail 70 into each combustion chamber of the engine body 11. A fuel injection timing and a fuel injection quantity are controlled by the ECU. Each of injectors 80 is connected to the fuel tank 20 through the fifth fuel pipe 95, so that an excess fuel is returned to the fuel tank 20 through the fifth fuel pipe 95.

As shown in Figure, the first fuel pipe 90 is provided with a pre-filter 90*a* and the first gauze filter 90*b*. The pre-filter 90*a* removes foreign matters contained in the fuel stored in the fuel tank 20. The first gauze filter 90*b* removes foreign matters contained in the fuel which has passed through the pre-filter 90*a*. The first gauze filter 90*b* has higher performance for removing foreign matters than the pre-filter 90*a*. The first gauze filter 90*b* removes fine foreign matters which the pre-filter 90*a* can not remove. Each of the pre-filter 90*a* and the first gauze filter 90*b* is made by weaving metallic threads in a reticular pattern. The interval between metallic threads of the first gauze filter is narrower than that of the pre-filter 90*a*.

The second fuel pipe 91 is provided with a first relief valve 91*a* which opens when the fuel pressure in the second fuel pipe 91 exceeds a predetermined value. The excess fuel discharged from the first relief valve 91*a* is returned to the first fuel pipe 90 (feed pump 30). Thereby, an excessive increase in fuel pressure in the second fuel pipe 91 is restricted to avoid a damage of the filter 40 connected to the second fuel pipe 91.

The third fuel pipe 92 is provided with a first orifice 92*a* and a second gauze filter 92*b* downstream of the first orifice 92*a*. The second gauze filter 92*b* removes foreign matters contained in the fuel which has passed through the filter 40 and foreign matters which fall off from the first orifice 92*a*. The third fuel pipe 92 is provided with a second relief valve 92*c* downstream of the second gauze filter 92*b*. The second relief valve 92*c* opens when the fuel pressure in the third fuel pipe 92 exceeds a predetermined value. The excess fuel discharged from the second relief valve 92*c* is returned to the first fuel pipe 90 (feed pump 30). Thereby, an excessive increase in fuel pressure in the third fuel pipe 92 is restricted to avoid a damage of the filter 40 connected to the third fuel pipe 92. Besides, a fuel quantity regulation valve 92*d* is provided in the third fuel pipe 92 downstream of the second gauze filter 92*b*. The fuel quantity regulation valve 92*d* regulates the fuel quantity which is to be supplied to the high-pressure pump 50. Thereby, the fuel quantity flowing into the fuel pressurizing chamber 56 can be regulated. An opening degree of the fuel quantity regulation valve 92*d* is controlled by the ECU according to the engine condition. The second gauze filter 92*b* has the same structure as the first gauze filter 90*b*.

The fourth fuel pipe 93 is provided with the second orifice 93*a* and a gas purging valve 93*b* which prevents a reverse flow of gas contained in the fuel discharged from the filter 40 into the fourth fuel pipe 93. Thereby, it is prevented that the gas contained in the fuel discharged into the fourth fuel pipe 93 flows back to the filter 40 and the gas is contained in the fuel flowing through the third fuel pipe 92 toward the high-pressure pump 50. Thereby, it is prevented that element parts constructing the high-pressure pump 50 and the engine body 11 are damaged due to expansion and contraction of the gas contained in the fuel. Besides, a backup filter 93*c* is provided in the fourth fuel pipe 93 downstream of the gas purging valve 93*b* in preparation for malfunction of the filter 40. Even if the filter 40 is damaged, the backup filter 93*c* can remove foreign matters contained in the fuel flowing through the fourth fuel pipe 93. The backup filter 93*c* has the same structure as the first gauze filter 90*b*.

Structural features and advantages of the fuel supply system 100 will be described hereinafter. As shown in Figure, the third fuel pipe 92 introducing the fuel from the filter 40 to the fuel pressurizing chamber 56 and the fourth fuel pipe 93 introducing the fuel from the filter 40 to the housing 57 are formed independently of each other. That is, the fourth fuel pipe 93 is a dedicated fuel pipe for introducing the fuel from the filter 40 to the housing 57. Thereby, unlike the structure in which the fourth fuel pipe is branched from the third fuel pipe, it is restricted that the burr of the pipes, the foreign matters adhering on the orifices 92*a*, 93*a*, and the foreign matters adhering on the fuel quantity regulation valve 92*d* deteriorate the cleanliness of fuel supplied to the housing 57 as lubricant. A deterioration of lubricating ability of the fuel is restricted, and a deterioration of an anti-seizure of a sliding portion of a high-pressure pump is restricted.

Further, since the fourth fuel pipe 93 is the dedicated fuel pipe for introducing the fuel from the filter 40 to the housing 57, the fourth fuel pipe 93 can be designed without respect to the structure of the third fuel pipe 92. Thereby, the length of the fourth fuel pipe 93 can be designed to be shortened, so that the fuel which has passed through the filter 40 can be contacted with the fourth fuel pipe 93 in a short length. Thus, it is restricted that the foreign matters contained in the fuel adhere on the inner surface of the fourth fuel pipe 93 and the cleanliness of the fuel flowing through the fourth fuel pipe 93 is deteriorated. A deterioration of lubricating ability of the fuel is restricted, and a deterioration of an anti-seizure of a sliding portion of a high-pressure pump is restricted.

if the fourth fuel pipe is branched from the third fuel pipe like the conventional system, a part of fuel which is to be supplied to the fuel pressurizing chamber 56 is always introduced into the housing 57 as lubricant without respect to a rotation condition of the feed pump 30. Even when the feed pump 30 is driven at low speed and the fuel is not sufficiently supplied to the engine body 11, a part of fuel is always supplied to the housing 57. Thus, it is likely hard to ensure the quantity of fuel supplied to the engine 11. On the other hand, according to the present embodiment, the fourth fuel pipe 93 is the dedicated fuel pipe for introducing the fuel from the filter 40 to the housing 57, so that the excess fuel at the filter 40 is supplied to the housing 57 through the fourth fuel pipe 93. Therefore, the fuel to be supplied to the engine body 11 does not run shortage due to the fuel supply to the housing 57.

If the outlet port of the fourth fuel pipe 93 is positioned below the sliding portions of the high-pressure pump 50, the gas contained in the fuel supplied from the fourth fuel pipe 93 to the housing 57 is enclosed in the fuel stored in the housing 57. When the gas contained in the fuel is increased, a density of the fuel per a unit volume is decreased and the lubricating ability of the fuel is deteriorated, whereby the anti-seizure of the sliding portion may be deteriorated.

According to the present embodiment, the outlet port of the fourth fuel pipe 93 is positioned above the sliding portion of the high-pressure pump 50. Thus, the fuel discharged from the outlet port is supplied to the housing 57 from above the fuel level, so that the gas contained in the fuel supplied from the outlet port is hardly enclosed in the fuel stored in the housing 57. Thereby, the gas contained in the fuel which is to be supplied to the sliding portion is restricted to be increased and the density of the fuel per a unit volume is restricted to be decreased. The lubricating ability of the fuel is restricted to be deteriorated and the anti-seizure of the sliding portion is restricted to be deteriorated.

According to the present embodiment, the housing 57, the common rail 70, and each cylinder of the engine body 11 are connected to the fuel tank 20 through the fifth fuel pipe 95 so that the excess fuel is returned to the fuel tank 20. The excess fuel can be reused to reduce the fuel consumption.

The present invention should not be limited to the disclosed embodiment, but may be implemented in other way without departing from the spirit of the invention.

In the above embodiment, the internal combustion engine 10 includes the common rail 70. However, the internal combustion engine may include no common rail.

In the above embodiment, the high-pressure pump 50 includes the cam ring 53. However, the high-pressure pump 50 may includes no cam ring 53.

What is claimed is:

1. A fuel supply system supplying a fuel in a fuel tank to an internal combustion engine, the fuel supply system comprising:

a feed pump pumping up the fuel in the fuel tank;

a filter removing a foreign matter contained in the fuel discharged from the feed pump; and a high-pressure pump suctioning and pressurizing the fuel filtrated by the filter, the high-pressure pump discharging the pressurized fuel toward the internal combustion engine, wherein the high-pressure pump includes a camshaft driven by the internal combustion engine, a cam rotated along with the camshaft, a plunger reciprocated by the cam, a fuel pressurizing chamber in which the fuel is suctioned and pressurized by a reciprocation of the plunger, and a housing accommodating a part of the plunger, the cam, and the camshaft, the fuel is supplied from the fuel tank to the feed pump through a first fuel pipe, the fuel is supplied from the feed pump to the filter through a second fuel pipe, the fuel is supplied from the filter to the fuel pressurizing chamber through a third fuel pipe, the fuel is supplied from the filter to the housing through the fourth fuel pipe, and the third fuel pipe and the fourth fuel pipe are formed independently of each other.

2. A fuel supply system according to claim 1, wherein the fuel flowing through the fourth fuel pipe is an excess fuel out of the fuel which has flowed into the filter.

3. A fuel supply system according to claim 1, wherein an outlet port of the fourth fuel pipe opening to the housing is positioned above a sliding portion of the high-pressure pump.

4. A fuel supply system according to claim 1, wherein the fourth fuel pipe is provided with a backup filter in preparation for a malfunction of the filter.

5. A fuel supply system according to claim 1, wherein the fourth fuel pipe is provided with a gas purging valve preventing a reverse flow of gas contained in the fuel discharged from the filter into the fourth fuel pipe.

6. A fuel supply system according to claim 1, wherein the first fuel pipe is provided with a pre-filter removing a foreign matter contained in the fuel stored in the fuel tank.

7. A fuel supply system according to claim 6, wherein the first fuel pipe is provided with a first gauze filter between the pre-filter and the feed pump, the first gauze filter removing a foreign matter contained in the fuel which has passed through the pre-filter.

8. A fuel supply system according to claim 1, wherein the second fuel pipe is provided with a first relief valve which opens when a fuel pressure between the feed pump and the filter exceeds a specified value.

9. A fuel supply system according to claim 1, wherein the third fuel pipe is provided with a second relief valve which opens when a fuel pressure between the filter and the high-pressure pump exceeds a specified value.

10. A fuel supply system according to claim 1, wherein the third fuel pipe is provided with a second gauze filter removing a foreign matter contained in the fuel which has passed through the filter.

11. A fuel supply system according to claim 1, wherein the third fuel pipe is provided with a fuel quantity regulation valve regulating a fuel quantity which is to be supplied to the fuel pressurizing chamber.

12. A fuel supply system according to claim 1, wherein the high-pressure pump and the internal combustion engine are fluidly connected to a fifth fuel pipe through which an excess fuel in the high-pressure pump and the internal combustion engine is returned to the fuel tank.

13. A fuel supply system according to claim 1, wherein the fuel flowing through the third fuel pipe contains a gas less than the fuel flowing through the fourth fuel pipe.

* * * * *